US006049987A

United States Patent [19]

Robell

[11] Patent Number: 6,049,987

[45] **Date of Patent: *Apr. 18, 2000**

[54] GRIDDED MEASUREMENT SYSTEM FOR CONSTRUCTION MATERIALS

[76] Inventor: Glenn Robell, 2621 SW. 167th Pl., Seattle, Wash. 98166

[ * ] Notice: This patent is subject to a terminal disclaimer.

[21] Appl. No.: 09/008,408

[22] Filed: Jan. 17, 1998

Related U.S. Application Data

[63] Continuation-in-part of application No. 08/944,385, Oct. 6, 1997, Pat. No. 5,842,280.

[51] Int. Cl.[7] ..... G01B 3/00

[52] U.S. Cl. ..... 33/1 B; 33/566

[58] Field of Search ..... 33/1 B, 1 BB, 33/1 G, 1 K, 1 F, 1 SD, 1 N, 404, 411, 194, 494, 562, 563, 566; 52/105

[56] References Cited

U.S. PATENT DOCUMENTS

| | | | |
|---|---|---|---|
| 2,375,427 | 5/1945 | Mannino | 33/1 B |
| 3,270,421 | 9/1966 | Jones | 33/759 |
| 4,779,346 | 10/1988 | Schafer | 33/1 B |
| 4,858,402 | 8/1989 | Putz | 52/105 |
| 4,870,788 | 10/1989 | Hassan | 52/105 |
| 4,924,644 | 5/1990 | Lewis | 52/105 |
| 5,195,249 | 3/1993 | Jackson | 33/1 B |
| 5,282,317 | 2/1994 | Carter et al. | 33/1 B |
| 5,638,605 | 6/1997 | Sligar | 33/494 |
| 5,673,489 | 10/1997 | Robell | 33/1 B |
| 5,673,490 | 10/1997 | Hill | 33/1 B |
| 5,819,422 | 10/1998 | Schafer | 33/1 B |
| 5,842,280 | 12/1998 | Robell | 33/566 |

FOREIGN PATENT DOCUMENTS

| | | | |
|---|---|---|---|
| 529509 | 6/1955 | Italy | 33/1 B |
| 590105 | 8/1947 | United Kingdom | 33/1 B |
| 1578521 | 11/1980 | United Kingdom | 33/1 B |

*Primary Examiner*—G. Bradley Bennett
*Attorney, Agent, or Firm*—Dorothy S. Morse

[57] ABSTRACT

An improved system and method of gridded measurement for the cutting of construction materials which comprises the imprinting of visually precise commonly used measurement markings upon the surfaces of construction materials during the manufacturing process to save time and improve the accuracy of cutting the construction materials on a job site wherein the improvement lies in the use of a plurality of non-perimeter horizontal and vertical unit measurement markings; protractor markings; and inverted numerals, informational markings, nailing guides, product specification markings, and curved lines. Angled cuts may be easily made by cutting along the opposite corners of a predetermined number of grids counted in both horizontal and vertical directions, through use of the protractor markings, or a combination of both. In preferred embodiments unit markings are numbered for quick dimensional reference and visually precise fractional markings are also used. The lines for commonly used markings may be highlighted, darkened, doubled, tripled, dashed or dotted, colored, or otherwise enhanced for easy recognition. Applications may include, but are not limited to, use on structural and non-structural panels such as wallboard, shower board, oriented strand board (OSB), insulation, fire retardant panel products, gypsum board, plywood, and other substantially rectangular material which must be cut to exact measurements on a construction job site.

40 Claims, 9 Drawing Sheets

GRIDDED MEASUREMENT SYSTEM FOR CONSTRUCTION MATERIALS

This application is a continuation-in-part application filed under 37 CFR 1.53 (b)(1) and based upon the earlier non-provisional patent application Ser. No. 08/944,385, filed by applicant on Oct. 6, 1997. Patent application Ser. No. 08/944,385, now U.S. Pat. No. 5,842,280, issued Dec. 1, 1998, is a divisional application based upon the disclosure provided by applicant in his U.S. Pat. No. 5,673,489 which issued on Oct. 7, 1997.

BACKGROUND

1. Field of Invention

This invention relates to methods and devices for accurately cutting construction materials, specifically to an improved time saving measurement system and a method by which to enhance the efficiency and accuracy of cutting construction materials on a job site, the system and method involving the imprinting during manufacture of grids and other measurement markings onto one or more surfaces of the construction materials. Applications may include, but are not limited to, use on structural and non-structural panels such as wallboard; shower board; oriented strand board (OSB); insulation; gypsum board; plywood; fire retardant panel products; HARDE BACKER and other HARDE PANEL products both manufactured by the James Harde Corporation from wood pulp fiber and/or fiber cement/gypsum and/or a combination thereof; structural and non-structural panels manufactured by Louisiana-Pacific Corporation such as their TOP KNOTCH® tongue-and-groove OSB flooring product and their OSB sheathing products including TECH SHIELD®, structural and non-structural panels manufactured by United States Gypsum Company such as their cementatious board DURROCK®, and interior sheetrock gypsum panels including GREEN BOARD®; structural and non-structural panels manufactured by Custom Building Products, Inc., including their WONDER-BOARD® product for underlayment; structural and non-structural panels manufactured by Georgia Pacific Corporation and Willamette Industries, Inc. such as their plywood products for wall sheathing, roof laydowns, and flooring; and any other essentially rectangular material which must be cut to exact measurements on a construction or renovation job site.

2. Description of Prior Art

During construction and renovation work building materials must be accurately measured prior to cutting to ensure that they will perform the functions for which they were intended. When building materials are mismeasured and a cut piece is too large for its intended use, additional time must be spent to reshape it. If a cut piece is too small and subsequently used, gaps may be present in a finished structure which detract from its appearance, and the functional integrity of the structure may also be compromised. Materials cut too small and discarded result in financial loss. Therefore, it is desirable to have a means for accurately and expediently cutting building materials on construction and renovation job sites.

One way to create a smaller piece of construction material out of a larger one is through the use of a tape measure and a marking device, such as a pencil, to place a series of small marks upon at least one surface of the large piece of construction material at a measured distance from one of its straight edges. The person cutting the material may then use the marks as an approximate cutting guide. In the alternative, the person needing to cut the construction material can connect two or more of the marks with a line, such as by use of a snapped chalk line or by using a pencil and a straight edged device, the line then being used as the cutting guide. The main disadvantage of making and connecting measurements marked on a piece of construction material at a job site is that it is time consuming. When sufficient time is taken to accurately place the marks, the accuracy of the cut is greatly improved, but at the expense of increased labor cost. Also, human error is commonly associated with the field measurement of multiple marks on a piece of construction material. People coming to work tired for a variety of reasons, those working outside for extended hours in extreme temperature conditions, and those pressured to finish a project in a short period of time, do not always focus their attention on the tape measure markings and can easily misread them, particularly the fractional markings. Also, lines which are thickly marked onto construction materials may also lead to cutting errors, particularly when a variance in the portion of the thick line cut is extended the full length of a four foot by eight foot, four foot by ten foot, or four foot by twelve foot sheet of construction material. The mistakes which result from such cutting errors waste both time and materials if they are not corrected prior to cutting.

Cutting tools are also known which aid in making precise cuts in drywall and other construction materials. The invention in U.S. Pat. No. 5,206,965 to Rowley (1993) discloses a utility knife with an angled structure associated with its housing which provides a guiding surface for making angled or mitered cuts along the edge of a piece of construction material, such as drywall. The invention in U.S. Pat. No. 5,265,342 to Lang, Jr. (1993) discloses a knife fastened to a rod which passes through an opening in a guide that rides along the edge of a piece of construction material. Graduations on the rod allow new cut widths without the repeated use of tape measures and marking devices.

Intersecting and angled lines printed upon construction materials are also known. The inventions in U.S. Pat. No. 4,858,402 to Putz (1989), U.S. Pat. No. 4,870,788 to Hassan (1989), and U.S. Pat. No. 5,673,489 to Robell, (1997) all disclose lined patterns on construction materials to facilitate the use and placement thereof. The present invention is an improvement in the gridded measurement system and method disclosed by Robell in the 1997 patent mentioned above. The improvements incorporated into the present invention comprise the addition of multiple non-perimeter horizontal and vertical unit measurement markings uniformly positioned within the central portion of the construction material surface; multiple protractor markings positioned within the central portion of the construction material surface; inverted numerals on the perimeter and non-perimeter horizontal and vertical unit measurement markings, reversed perimeter and non-perimeter unit measurement markings; number blocks at intersections of horizontal and vertical unit measurement markings; centrally positioned informational markings; nailing guides, product specifications including trademarked phrases and company names, and short and extended curved line superimposed on the gridded system. These improvements provide a person needing to cut construction materials with an even faster and more accurate system and method for the cutting of construction materials than is possible with any known prior art, particularly when the person is cutting irregularly shaped remnant pieces of construction material. Use of the present invention also minimizes construction waste due to mismeasurement, and each piece of the present invention used on a construction site, including remnant pieces, will provide a handy onsite, time-saving reference for other measurement needs, a reference that can be accurate to one-one-thousandth of an inch, or its equivalent, when markings are laser cut.

SUMMARY OF INVENTION—OBJECTS AND ADVANTAGES

It is the primary object of this invention to provide an improved system and method by which to enhance the accuracy of cutting pieces of construction materials so as to prevent waste of construction materials. It is also an object of this invention to provide an improved time saving means by which to accurately cut pieces of construction materials. A further object of this invention is to provide an easy and expedited means for making angled or mitered cuts on pieces of construction materials. It is also an object of this invention to provide imprinted measuring grids on pieces of construction material which are sized and highlighted in a variety of commonly used measuring units. A further object of this invention is to provide an imprinted multiple grids-within-a-grid measuring system having fractional measurements for accurate measurement to one-one thousandth of an inch, or its equivalent. It is a further object of this invention to provide other features superimposed over the multiple grids-within-a-grid system to meet specialized construction needs.

As described herein, properly manufactured and imprinted on a piece of construction material, the present invention would provide an improved time saving means for accurately cutting construction materials. Precisely marked gridded lines, spaced apart from one another in standard measurement units, would be placed both horizontally and vertically on at least one surface of a piece of construction material. Numerals would be marked in association with whole measuring units for fast identification of dimensions which are required for a cut. In one preferred embodiment of the present invention, each numeral used in the perimeter horizontal and vertical unit measurement markings would have an identical inverted number associated therewith so that a person standing on any side of a rectangular piece of construction material can easily see a non-inverted numeral on both the near side and the opposed side of the material. Unit measurement markings could be placed around the perimeter of a piece of construction material or at a preset spaced-apart distance from the actual perimeter of the piece of construction material. Fractional markings would also be available for increased precision in cutting the construction material and could allow a cutting accuracy of at least one-one-thousandth of an inch, or its equivalent, when such markings are laser cut. It is contemplated for all such markings to be visually precise and imprinted on the construction material with an accuracy of one-one-thousandth of an inch. It is also contemplated for the lines marking commonly used measurements, such as the sixteen inch measurement between studs, to be highlighted, darkened, doubled, tripled, dashed, dotted, color enhanced, or otherwise enhanced on the grid for quick reference. Although angled and mitered cuts could be easily made by cutting along the opposite corners of a predetermined number of grids counted in both horizontal and vertical directions, in another preferred embodiment multiple protractors are positioned upon the surface of the construction material to facilitate the cutting of angled lines, particularly on previously cut remnant pieces of construction material. Depending on the size of the construction material sheet, the protractors could be centered, placed at alternate intersections of horizontal and vertical unit measurement markings, placed at intersections of horizontal and vertical unit measurement markings adjacent to each corner of the sheet, or placed in any other position or pattern helpful to a particular use. Also, although not critical, it is contemplated for the protractor markings to be accurately imprinted upon the construction materials in contrasting colors which enhance their visibility, but at the same time not to detract from the use of the gridded measurement markings adjacent to them. The gridded measurement markings aid in providing a quick measurement reference and also provide convenient guides for cutting straight lines through construction material. Further, a quick glance at the markings on a remnant piece of construction material having the grid measurement system of the present invention will more rapidly reveal the presence of a straight edge, a 90-degree angle between adjacent edges without measurement, or whether the piece has the minimum dimension required for a particular purpose. In a third embodiment of the present invention additional non-perimeter horizontal and vertical unit measurement markings are uniformly positioned centrally on the surface of the construction material. While helpful in making more rapid original cuts on construction materials, such non-perimeter horizontal and vertical unit measurement markings are particularly useful in cutting construction material remnants. In the present invention it is contemplated for at least one non-perimeter horizontal and one non-perimeter vertical measurement unit marking to be placed at regularly spaced intervals between adjacent highlighted markings. It is also contemplated for the present invention to comprise inverted and/or reversed unit measurement markings associated with both perimeter and non-perimeter horizontal and vertical unit measurement markings, widened unit measurement markings which provide a narrow strip of measurement information such as "1F", "2F", etc. or 16", 32", 48", etc., number blocks repeatedly associated with certain identified intersections of horizontal and vertical unit measurement markings, and informational markings such as but not limited to the type of measurement systems used and the type of measurements enhanced by highlighted markings, seasonal messages, product specification markings to include display of company logos, company names, and/or trademarked phrases, as well as nailing guides and various curved lines superimposed over the multiple gridded measurement system to meet specialized construction needs, such as those of the marine industry.

The description herein provides preferred embodiments of the present invention but should not be construed as limiting its scope. Variations in the units used to configure the grids, the selection of fractional markings displayed, the number of protractor markings used, the number of non-perimeter horizontal and vertical unit measurement markings used, the configuration and pattern of the nailing guides used, the selection of commonly used construction measurements chosen for highlighting, darkening, doubling, tripling, dashing, dotting, or color enhancing, the frequency of the numerals used to identify grid units, and the use of numerals for other grid measurement markings, other than those shown and described herein, can be incorporated into the present invention. Thus the scope of the present invention should be determined by the appended claims and their legal equivalents, rather than the examples given.

DETAILED DESCRIPTION OF PREFERRED EMBODIMENTS

Figure 1:
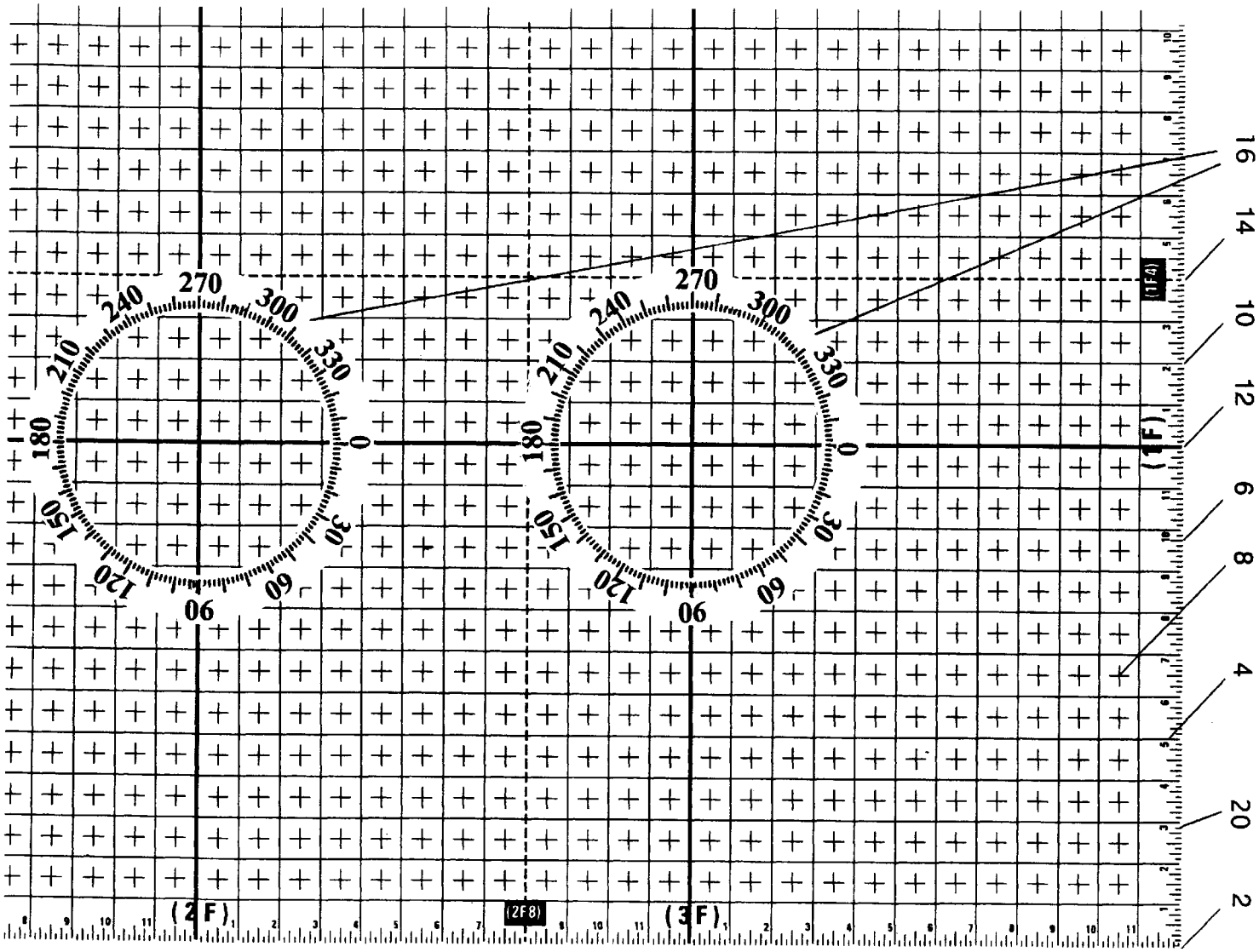
FIG. 1 is a sectional top view of a first preferred embodiment of the invention having multiple protractor markings positioned thereon.

FIG. 1 shows the upper right portion of a first preferred embodiment of an improved gridded measurement system 2 for use with a variety of building materials (not shown), to include but not be limited to wallboard, shower board, oriented strand board (OSB), insulation, fire retardant panel product, gypsum board, plywood, and any other essentially rectangular material, particularly four foot by eight foot, four foot by ten foot, and four foot by twelve foot sheets, which must be cut to exact measurements on a construction or a renovation job site. In addition, it is contemplated for gridded measurement system 2 to be used for the placement of visually precise units measurement markings on construction materials which have length and width dimensions ranging between a minimum of approximately one foot and a maximum of approximately thirty-six feet, a thickness dimension ranging between a minimum of approximately one-eighth of an inch and a maximum of approximately four inches, and which are configured as engineered wood products including oriented strand board (OSB); fiber cement products; combination products comprising both fiber cement and wood fiber; cementatious products; products comprising radiant barriers; tongue-and-groove panel products; panel products with one or more ship-lap type edges on one side; panel products with one or more ship-lap type edges on both sides; panel products with paint grade type faces; panel products with decorative paintable faces consisting of grooved patterns; and panel products with decorative paintable faces consisting of various wood grain textures including T-111.

Although the length and width dimensions of gridded measurement system 2 can vary according to a particular need, FIG. 1 shows gridded measurement system 2 being three feet wide and of an undetermined length. It is contemplated for gridded measurement system 2 to be applied to at least one flat surface of a piece of construction material (not shown), however, gridded measurement system 2 may be applied to all surfaces appropriate for a particular use. FIG. 1 shows gridded measurement system 2 having visually precise one-fourth inch markings 6, visually precise one-eighth inch markings 20, visually precise one-half inch markings 8, visually precise one inch markings 10, twelve inch enhanced markings 12, and sixteen inch highlighted markings 14 indicated in both horizontal and vertical directions. Although not shown, one inch markings 10 could be made wider than shown in FIG. 1 to comprise very thin measuring strips consisting of visually precise one-fourth inch markings 6, visually precise one-eighth inch markings 20, visually precise one-half inch markings 8, visually precise twelve inch enhanced markings 12, and visually precise sixteen inch highlighted markings 14, or combinations thereof with visually precise inverted numerals, shown in FIG. 2 as number 18, or inverted and reversed measuring strips similar to the opposed perimeter measuring strips shown in FIG. 5. As a further example, such widened one inch markings 10 could also provide markings of "1F", "2F", "3F", "4F", "5F", 6"F", "7F", "8F", and the like, or markings of 16", 32", 48", 64", "80", and the like.

Sixteen inch highlighted markings 14 are used as a quick reference for the sixteen inch distance commonly used in the construction industry between studs (not shown). FIG. 1 also shows gridded measurement system 2 having visually precise numerals 4 associated with one inch markings 10 and visually precise protractor markings 16 positioned at the intersections of horizontal and vertical twelve inch enhanced markings 12. Although FIG. 1 shows protractor markings 16 placed in association with every such intersection, such placement is not critical and it is contemplated for a sufficient number of protractor markings 16 to be placed uniformly within the central portion of the surface of the construction material so as to enhance the speed with which angled cuts in the construction material can be made. In contrast, on smaller sheets of construction materials (not shown), one large protractor marking 16 could be centered thereon, or four protractor markings 16 could be used with one protractor marking 16 positioned adjacent to each of the sheet's four corners. Also, the orientation of each protractor marking 16 within each intersection is not critical, as long as the zero mark of each is positioned along one of the four underlying twelve inch enhanced markings 12 within the intersection. As a result, FIG. 1 shows the zero mark of the upper protractor marking 16 pointing toward the top of FIG. 1 and the zero mark of the lower protractor marking 16 pointing toward the bottom of FIG. 1.

Although the preferred embodiment of gridded measurement system 2 shown in FIG. 1 shows markings in inches, it is contemplated for markings to also be in other commonly used measurement units, such as metric units. Further, it is also contemplated for numerals 4 to be associated with markings other than one inch markings 10, and to be associated with either odd or even one inch markings 10. In addition, it is contemplated for commonly used measurements needed for reference, other than twelve inch markings 12 and sixteen inch markings 14 to be highlighted or enhanced. It is also contemplated for highlighting and enhancing to include, but not be limited to, color enhancement, darkening of lines, doubling of lines, tripling of lines, and a series of dots adjacent to or in place of a line. In addition to dots, other objects could be used for enhancement such as stars, percent signs, crosses, dollar signs, cents signs, diamonds, hearts, cloverleaves, and a string of alphabet letters. Highlighting could also include dashed lines with each dashed mark having an identical measurement useful to the construction industry; such as one-half inch marking 8 with spaces between each dashed mark also having the same identical measurement. Although FIG. 1 shows one-fourth inch markings 6, one-half inch markings 8, and one-eighth inch markings 20, it is contemplated to have other fractional markings as needed to suit a particular construction purpose. Also, although not critical, it is contemplated for protractor markings 16 to be imprinted in a color contrasting with the color used to imprint one-half inch markings 8, one inch markings 10, twelve inch enhanced markings 12, and sixteen inch highlighted markings 14. Further, although protractor markings 16 are shown in the form of a ring with a single set of numbers therearound, it is contemplated for protractor markings 16 to have other configurations, dimensions and positioning as long as protractor markings 16 are sufficiently large and precisely marked to be easily and accurately used. For example, protractor markings 16 could also have an inverted set of numerals within its measurement ring; an inverted set of numerals positioned outside its measurement ring; different numerals between adjacent twelve inch enhanced markings 12, such as 45, 30 and 60, or 30, 45, and 60; or be positioned between the intersections of every other twelve inch enhanced marking 12.

Angled and mitered cuts are easily and accurately made using the visual precision of gridded measurement system 2, either through use of protractor markings 16 or through use of one inch markings 10. For example, a 45-degree angled cut may be made by cutting through opposite corners of one inch markings 10. Other angles may be cut along the opposite corners of a predetermined number of one inch markings 10 counted in both horizontal and vertical directions. For convenience in cutting such angles, a straight edge (not shown) and a marking device (not shown), such as a chalk line, may be used to draw a line connecting the counted opposite corners. However, no angle measurements need to be determined with a separate protractor tool (not shown), the misalignment of which during measurement is a common source of error. It is contemplated for gridded measurement system 2 to be imprinted on construction materials of any thickness, as well as construction materials which have length and width dimensions ranging between a minimum of approximately one foot and a maximum of approximately thirty-six feet. Gridded measurement system 2 can be imprinted for an insignificant cost, as compared to the cost of the construction material itself (not shown), by screen printing, laser guided printing, or pad printing. When laser guided printing is used, flexigraphic plates can be laser cut to one-one-thousandths of an inch accuracy, and it is the most preferred method of use for making gridded measurement system 2.

Figure 2:
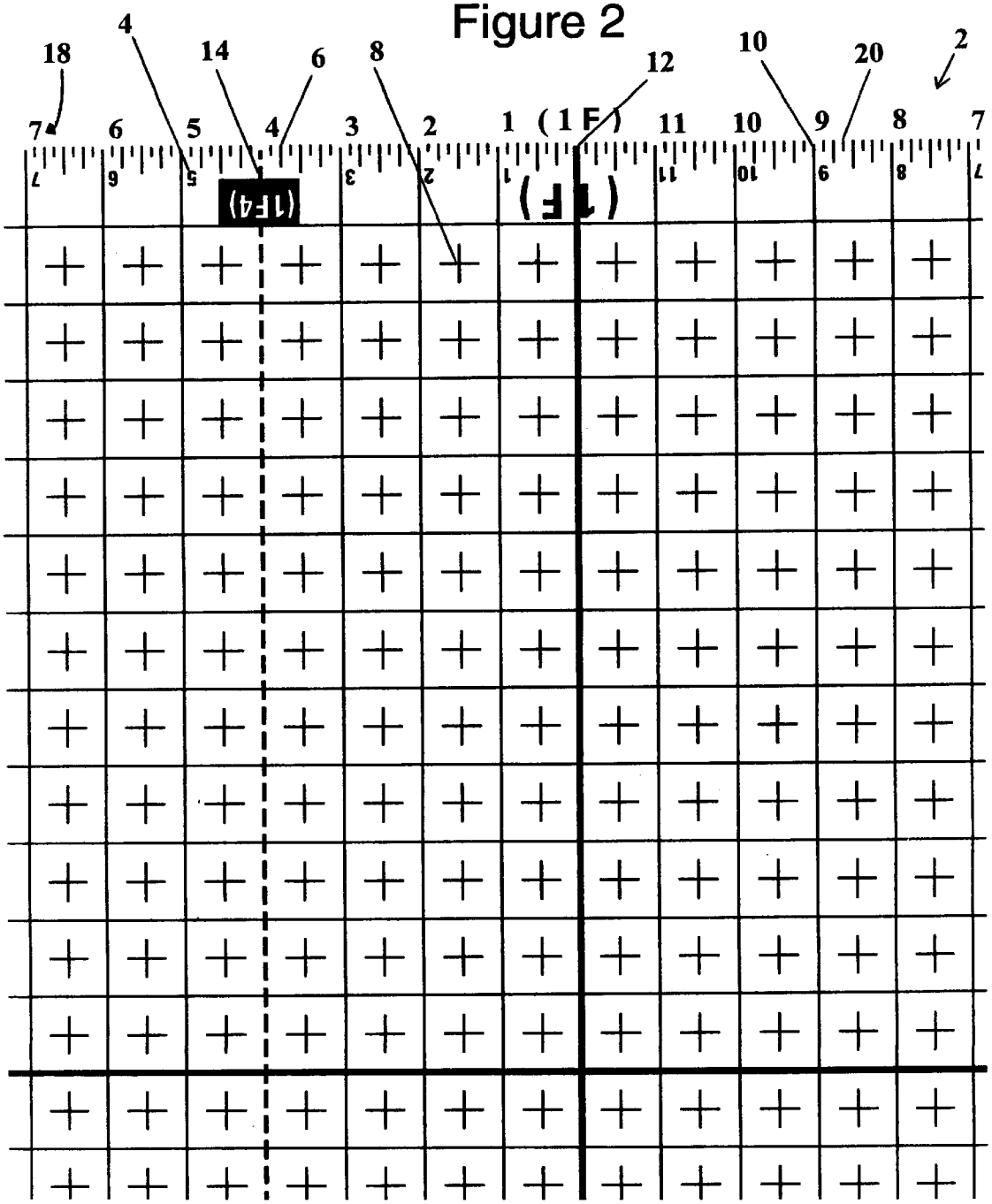
FIG. 2 is a sectional top view of a second preferred embodiment of the invention having an identical inverted numeral positioned adjacent to each of the numerals within the perimeter horizontal and vertical unit measurement markings.

FIG. 2 shows a second preferred embodiment of an improved gridded measurement system 2. FIG. 2 shows gridded measurement system 2 having visually precise one-fourth inch markings 6, visually precise one-eighth inch markings 20, visually precise one-half inch markings 8, visually precise one inch markings 10, twelve inch enhanced markings 12, and sixteen inch highlighted markings 14 indicated in both horizontal and vertical directions. FIG. 2 also shows gridded measurement system 2 having visually precise numerals 4 associated with one inch markings 10 and an inverted numeral 18 associated with each numeral 4. The use of inverted numerals 18 allow a person (not shown) positioned on any side of a piece of construction materials, or remnant thereof, to see non-inverted numbers on the opposed side for easier and more rapid identification of needed measurement markings. Although FIG. 2 only shows numerals 4 associated with one inch markings 10 and inverted numerals 18 associated with numerals 4, in the preferred embodiment of gridded measurement system 2 it is contemplated to have numerals 4 associated with any measurement marking and inverted numerals 18 associated with any or all numerals 4. It is also contemplated for numerals 4 and inverted numerals 18 to complement one another. For example, numerals 4 could comprise only odd numbers with inverted numerals 18 comprising even numbers; both numerals 4 and inverted numerals 18 could comprise every consecutively increasing third number or every consecutively increasing fourth number; or various combinations of numerals 4 and inverted numerals 18 could be positioned in the central portions of a piece of construction material, between the perimeter horizontal and vertical unit measurement markings to enhance the speed with which a person needing to cut a piece of construction material can locate needed dimensions.

Figure 3:
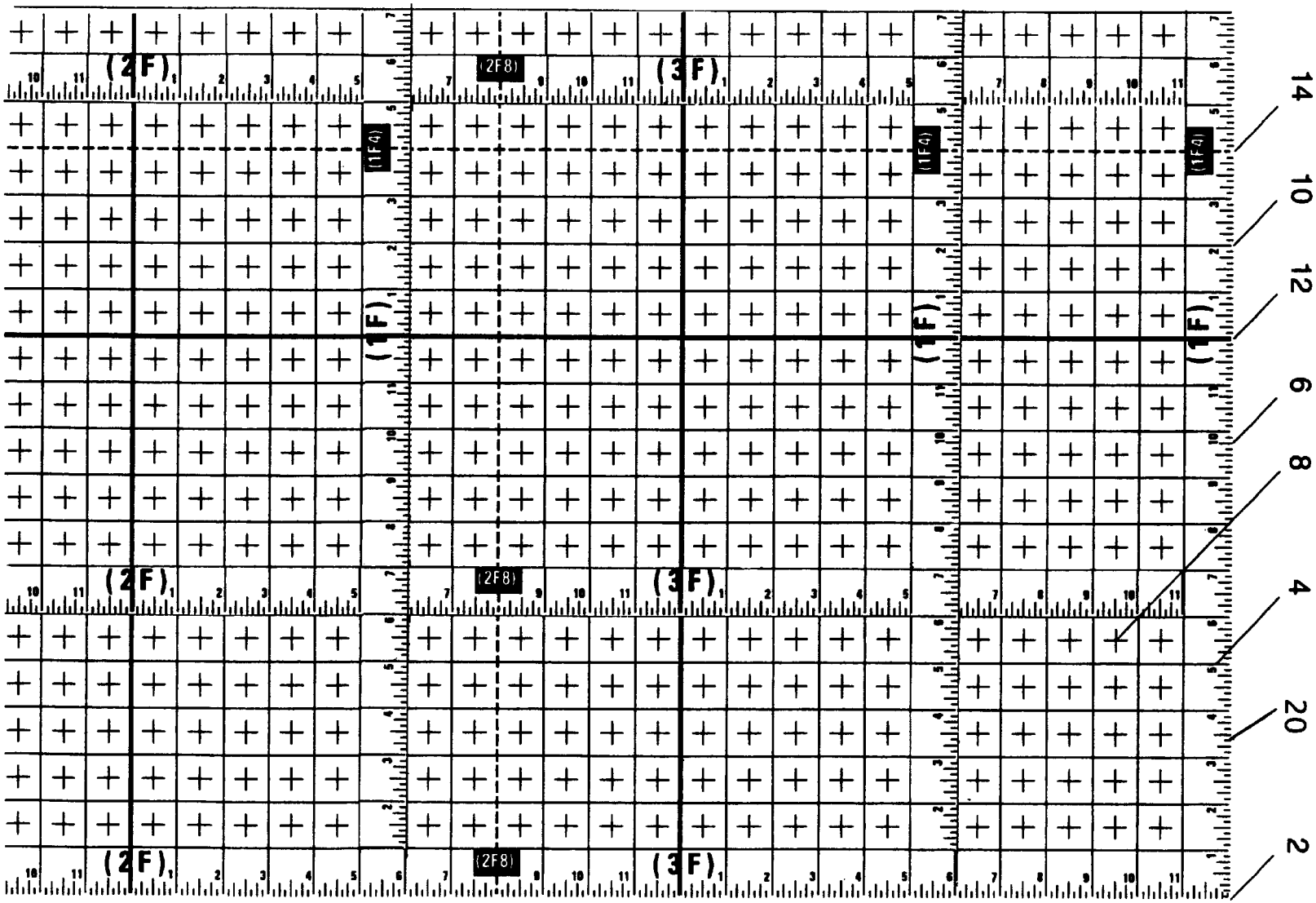
FIG. 3 is a sectional top view of a third preferred embodiment of the invention having multiple non-perimeter horizontal and vertical unit measurement markings positioned thereon.

FIG. 3 shows a third preferred embodiment of an improved gridded measurement system 2. FIG. 3 shows gridded measurement system 2 having visually precise one-fourth inch markings 6, visually precise one-eighth inch markings 20, visually precise one-half inch markings 8, visually precise one inch markings 10, twelve inch enhanced markings 12, and sixteen inch highlighted markings 14 indicated in both horizontal and vertical directions. FIG. 3 also shows gridded measurement system 2 having visually precise numerals 4 associated with one inch markings 10. In addition, FIG. 3 shows one-fourth inch markings 6, one-eighth inch markings 20, one-half inch markings 8, and one inch markings 10 positioned both horizontally and vertically around the perimeter of gridded measurement system 2, as well as at various positions throughout the central portion of gridded measurement system 2. Although the configuration and number of the centrally positioned one-fourth inch markings 6, one-eighth inch markings 20, one-half inch markings 8, and one inch markings 10 is not critical, it is contemplated that they be sufficient in number and configuration to enhance the ease and speed of use of the construction material (not shown) on which it is imprinted. For example, alternative configurations could include, but would not be limited to, the placement of one-fourth inch markings 6, one-eighth inch markings 20, one-half inch markings 8, and one inch markings 10 every sixth inch both horizontally and vertically; similar markings placed every fourth inch both horizontally and vertically; similar markings placed every fifth centimeter both horizontally and vertically; similar markings placed centrally between every other consecutive twelve inch marking 12; or similar markings placed once horizontally and once vertically through the centers of the piece of construction material. Also, as in the discussion above concerning FIG. 1, every one inch marking 10, or selected one inch markings 10, could be widened to comprise very thin measuring strips consisting of visually precise one-fourth inch markings 6, visually precise one-eighth inch markings 20, visually precise one-half inch markings 8, visually precise twelve inch enhanced markings 12, and visually precise sixteen inch highlighted markings 14, or combinations thereof with visually precise inverted numerals, shown in FIG. 2 as number 18, or inverted and reversed measuring strips similar to the opposed perimeter measuring strips shown in FIG. 5. As a further example, such widened one inch markings 10 could also provide markings of "1F", "2F", "3F", "4F", "5F", 6"F", "7F", "8F", and the like, or markings of 16", 32", 48", 64", "80", and the like.

Figure 4:
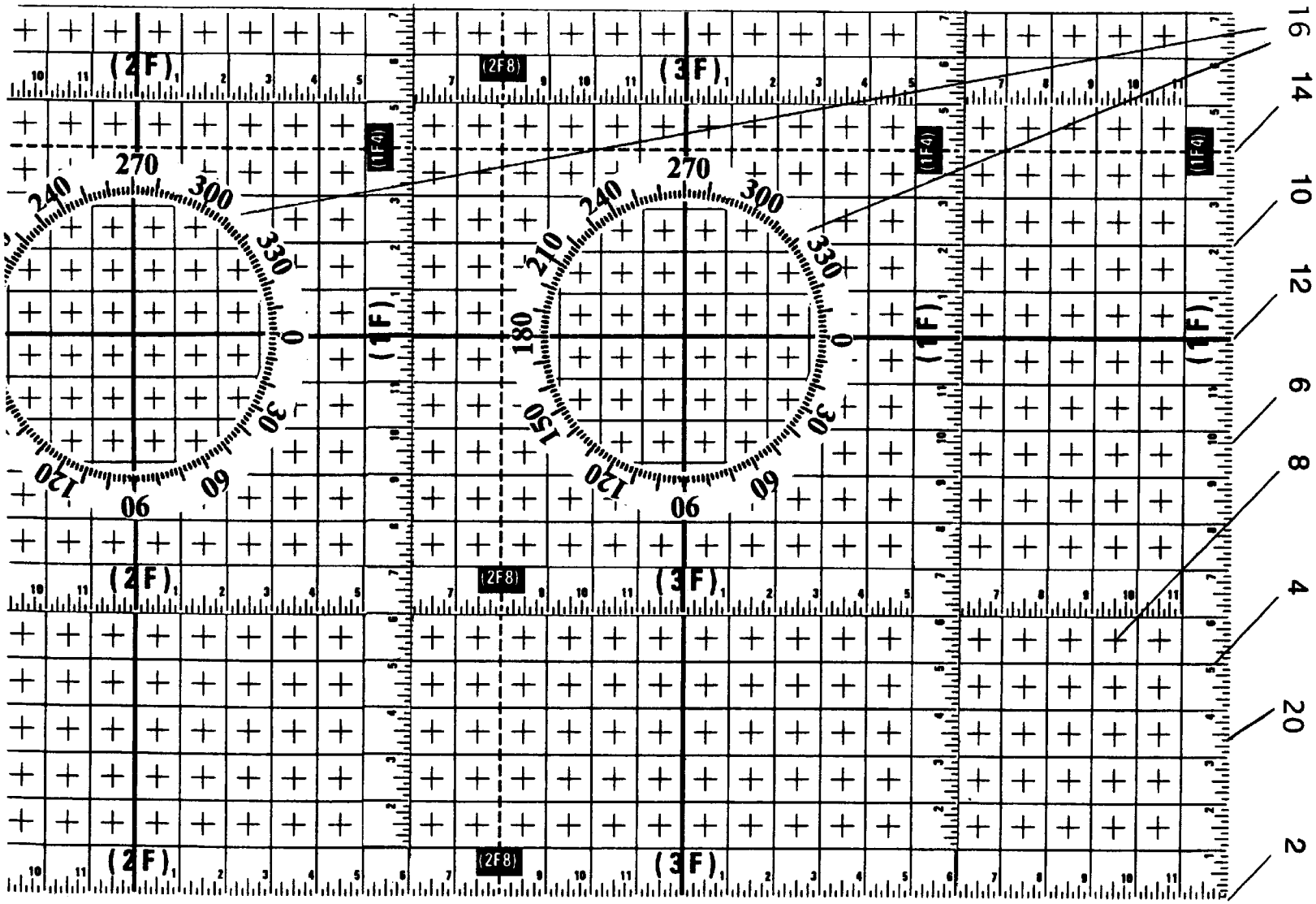
FIG. 4 is a sectional top view of a fourth preferred embodiment of the invention having multiple non-perimeter horizontal and vertical unit measurement markings positioned thereon and multiple protractor markings also positioned thereon and placed over the intersections of the enhanced twelve inch lines.

FIG. 4 shows a fourth preferred embodiment of an improved gridded measurement system 2. FIG. 4 shows gridded measurement system 2 having visually precise one-fourth inch markings 6, visually precise one-eighth inch markings 20, visually precise one-half inch markings 8, visually precise one inch markings 10, twelve inch enhanced markings 12, and sixteen inch highlighted markings 14 indicated in both horizontal and vertical directions. FIG. 4 also shows gridded measurement system 2 having visually precise numerals 4 associated with one inch markings 10; one-fourth inch markings 6, one-eighth inch markings 20, one-half inch markings 8, and one inch markings 10 positioned both horizontally and vertically around the perimeter of gridded measurement system 2, as well as at various positions throughout the central portion of gridded measurement system 2; and multiple protractor markings 16 positioned over the intersections of twelve inch markings 12. The combination of multiple protractor markings 16 and one-fourth inch markings 6, one-eighth inch markings 20, one-half inch markings 8, and one inch markings 10 positioned both horizontally and vertically around the perimeter of gridded measurement system 2, as well as at various positions throughout the central portion of gridded measurement system 2 is particularly suited to construction projects where many smaller pieces of construction materials must be cut from larger ones.

Figure 5:
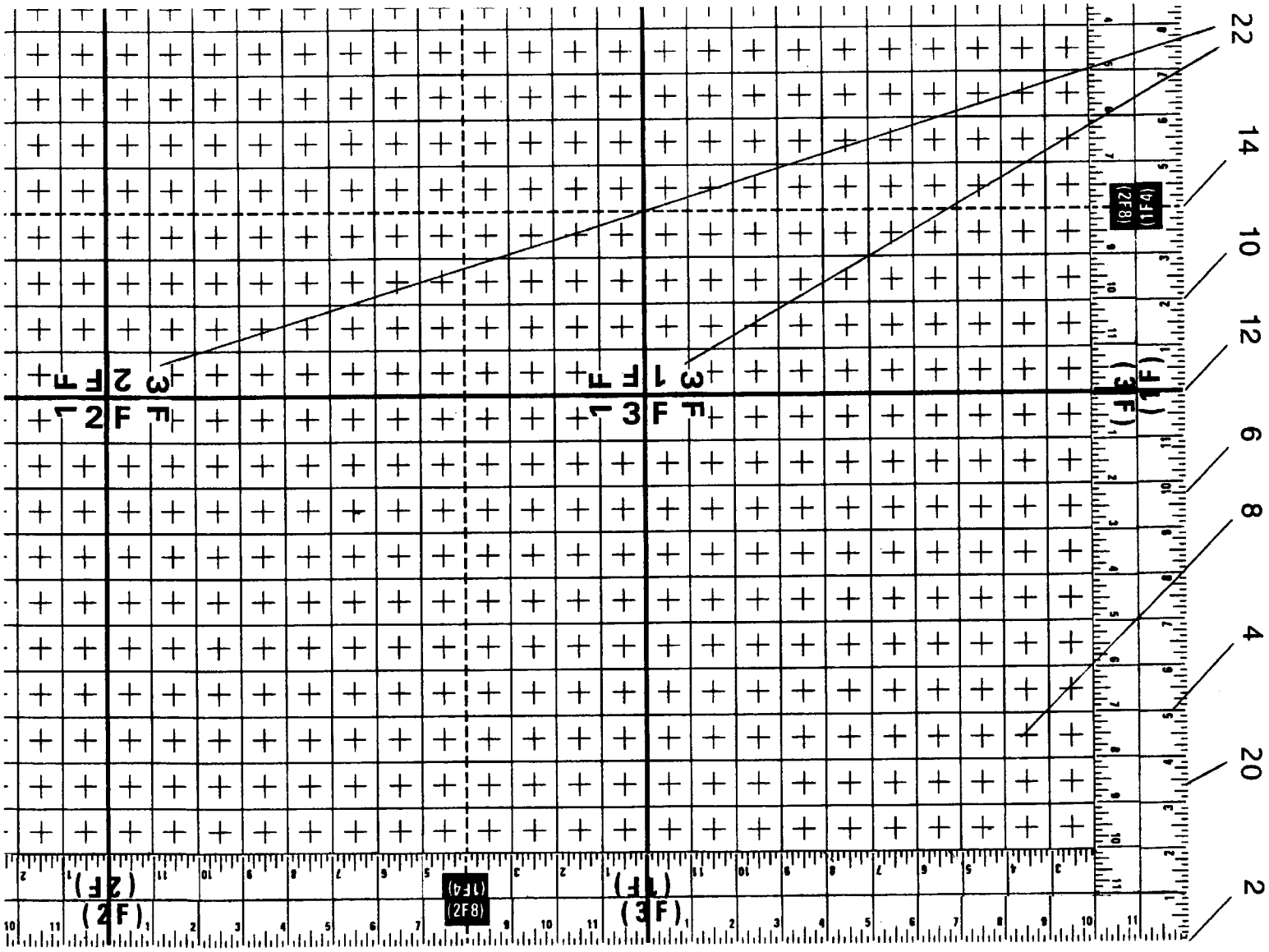
FIG. 5 is a sectional top view of a fifth preferred embodiment of the invention having inverted and reversed perimeter horizontal unit measurement markings, inverted and reversed vertical unit measurement markings, and centrally positioned number blocks comprising inverted horizontal and vertical measurement markings.

FIG. 5 shows a fifth preferred embodiment of an improved gridded measurement system 2. FIG. 5 shows gridded measurement system 2 having visually precise one-fourth inch markings 6, visually precise one-eighth inch markings 20, visually precise one-half inch markings 8, visually precise one inch markings 10, twelve inch enhanced markings 12, and sixteen inch highlighted markings 14 indicated in both horizontal and vertical directions. FIG. 5 also shows gridded measurement system 2 having visually precise numerals 4 associated with one inch markings 10; inverted and reversed perimeter horizontal and vertical measurement markings to include one-fourth inch markings 6, one-eighth inch markings 20, one-half inch markings 8, and one inch markings 10; and centrally positioned number blocks 22 comprising inverted and reversed horizontal measurement markings, as well as inverted and reversed vertical measurement markings. Although FIG. 5 shows number blocks 22 positioned at every intersection of twelve inch enhanced markings 12, it is contemplated for number blocks 22 to be positioned at any combination of intersections of one inch markings 10, twelve inch enhanced markings 12, or sixteen inch highlighted markings 14. FIG. 5 shows adjacent number blocks 22 having numbers facing each direction which increase from left to right, but it is also contemplated for adjacent number blocks 22 to have numbers which increase from right to left. The inverted and reversed perimeter horizontal and vertical measurement markings which include one-fourth inch markings 6, one-eighth inch markings 20, one-half inch markings 8, and one inch markings 10, can similarly comprises numbers which increase from left to right, as well as from right to left. The color used to mark number blocks 22 is not critical, but in the preferred embodiment it is contemplated for number blocks to comprise contrasting colors so that they are easily and rapidly distinguishable. The combination of number blocks 22 and one-fourth inch markings 6, one-eighth inch markings 20, one-half inch markings 8, and one inch markings 10 positioned both horizontally and vertically around the perimeter of gridded measurement system 2, is also well-suited to construction projects where many smaller pieces of construction materials must be cut from larger ones, as well as in situations where efficient use of construction material remnant pieces is important.

Figure 6:
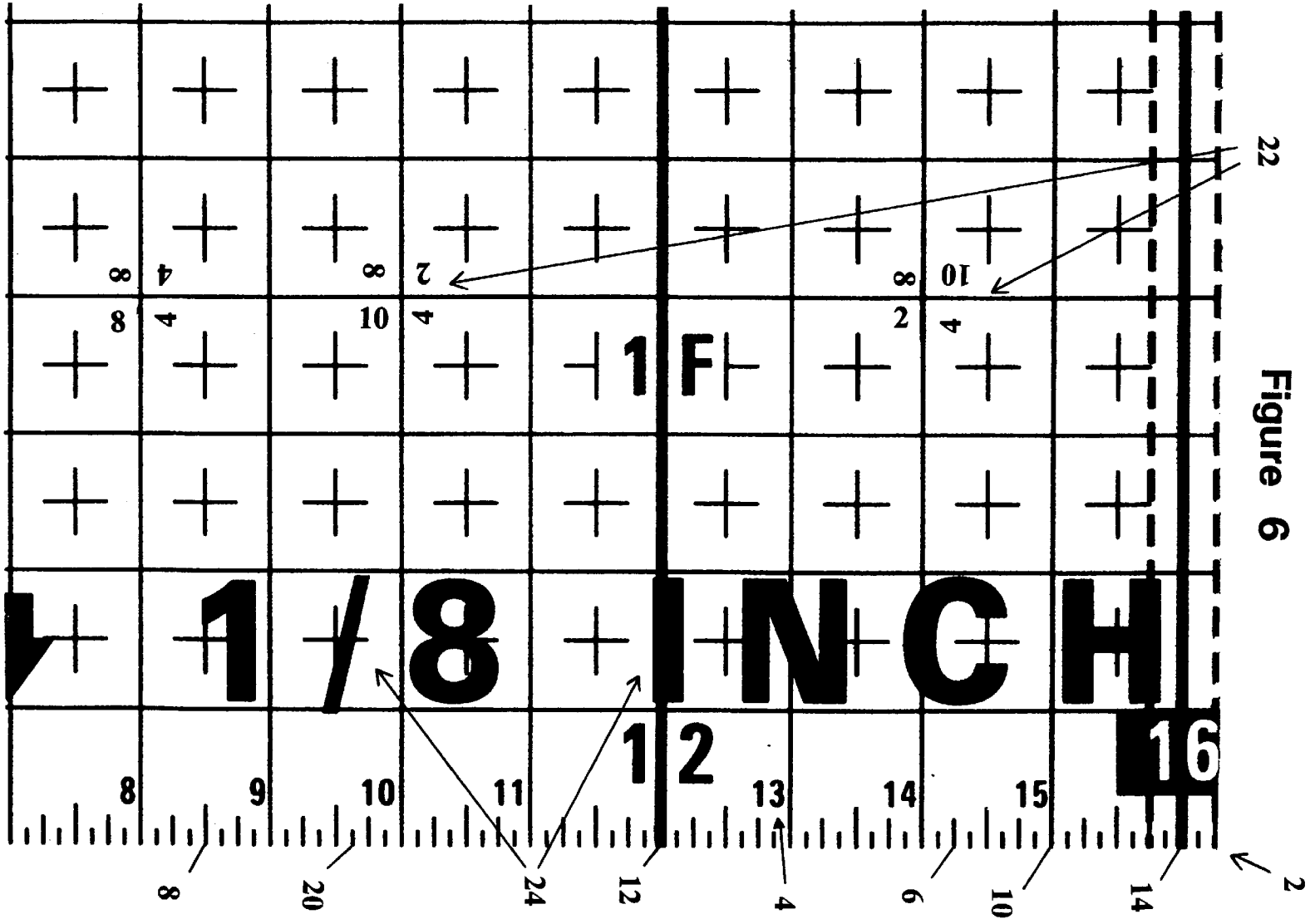
FIG. 6 is a sectional top view of a sixth preferred embodiment of the invention having centrally positioned number blocks comprising inverted horizontal and vertical measurement markings and centrally positioned informational markings.

FIG. 6 shows a sixth preferred embodiment of gridded measurement system 2. FIG. 6 shows gridded measurement system 2 having visually precise one-fourth inch markings 6, visually precise one-eighth inch markings 20, visually precise one-half inch markings 8, visually precise one inch markings 10, twelve inch enhanced markings 12, and sixteen inch highlighted markings 14 along one portion of its perimeter. FIG. 6 also shows gridded measurement system 2 having visually precise numerals 4 associated with one inch markings 10, as well as centrally positioned informational markings 24 and centrally positioned number blocks 22 comprising inverted horizontal and vertical measurement markings. In the preferred embodiment it is contemplated for informational markings 24 to marked with contrasting colors for enhanced visibility and to be used for, but not be limited to, the providing of information about measurement markings and/or highlighting for a special purpose, the providing of information about the type of measurement units used, and the display of seasonal messages. FIG. 6 shows the measurement markings in adjacent number blocks 22 increasing from left to right and identifying the number of inches a particular intersection is located from the next adjacent left twelve inch enhanced marking 12. However, it is also contemplated for the measurement markings in adjacent number blocks 22 to increase from right to left and identify the number of inches a particular intersection is located from the next adjacent right twelve inch enhanced marking 12. Although not shown, it is further contemplated for the measurement markings in adjacent number blocks 22 to increase or decrease relative to one another to identify the number of inches each particular intersection is located in a chosen direction from one of the horizontal or vertical perimeters of the piece of construction material on which gridded measurement system 2 is imprinted.

Figure 7:
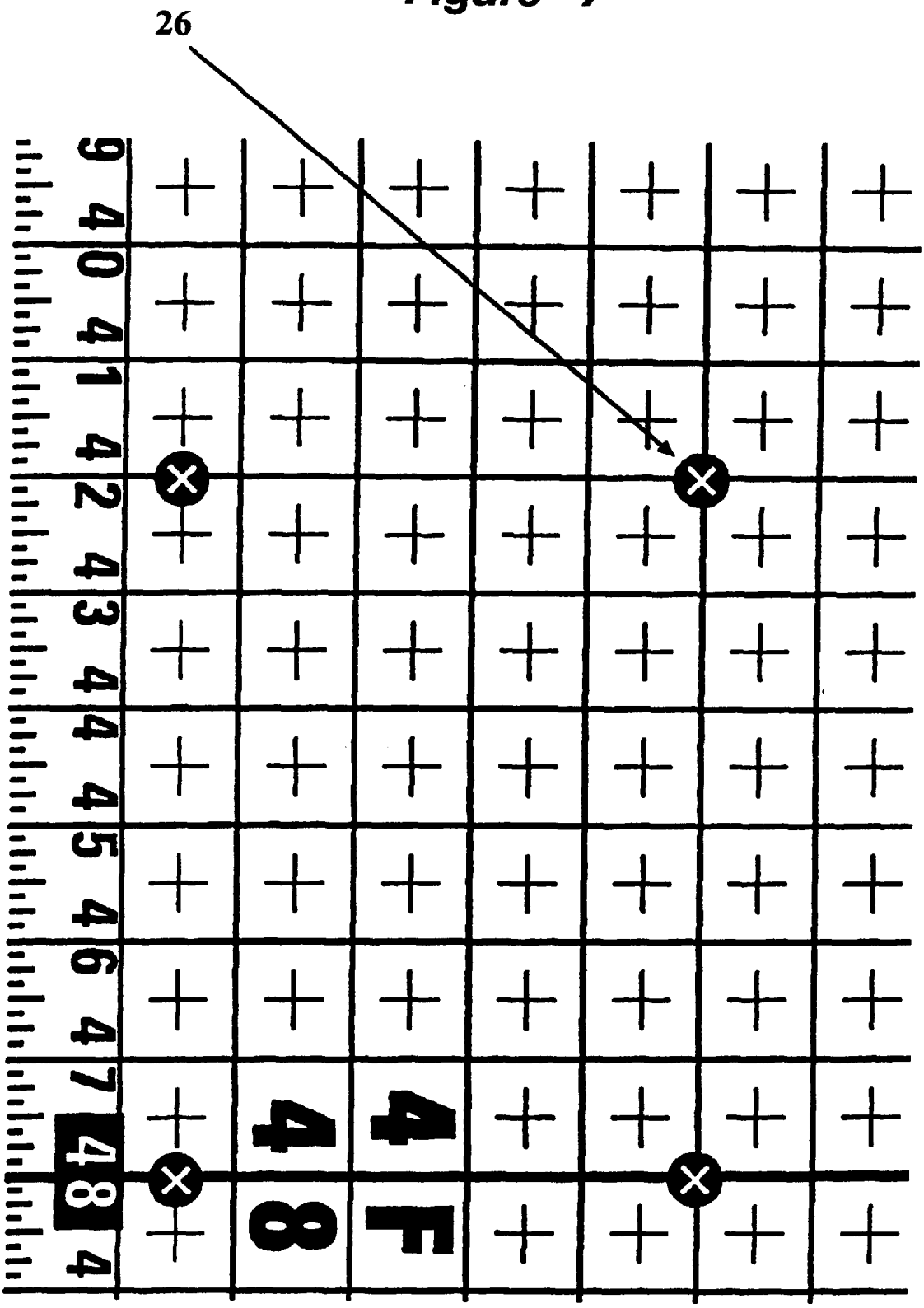
FIG. 7 is a sectional top view of a seventh preferred embodiment of the invention having nailing guides positioned on selected intersections of unit measurement markings.
Figure 8:
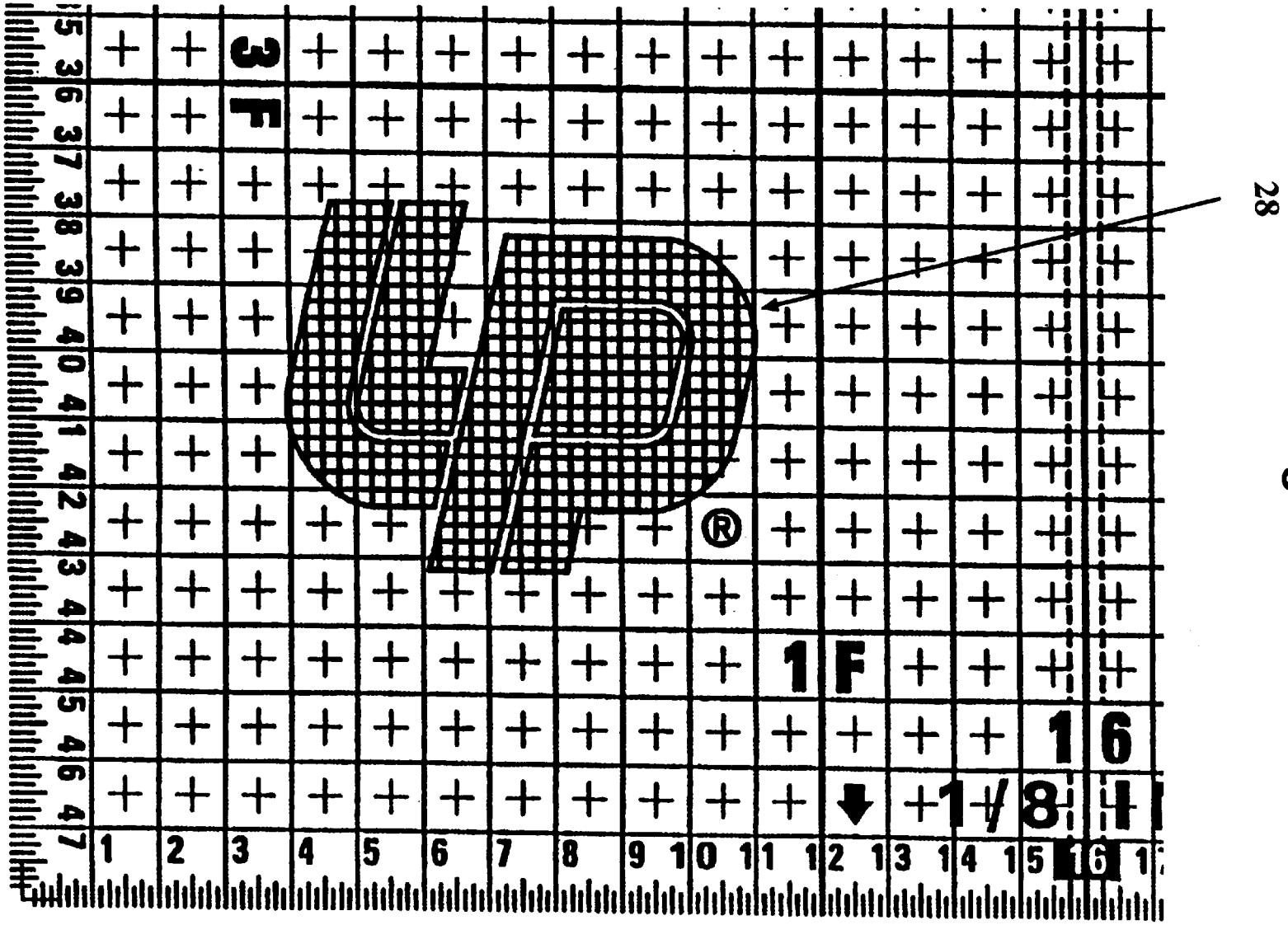
FIG. 8 is a sectional top view of an eighth preferred embodiment of the invention having a trademarked logo positioned superimposed over unit measurement markings.
Figure 9:
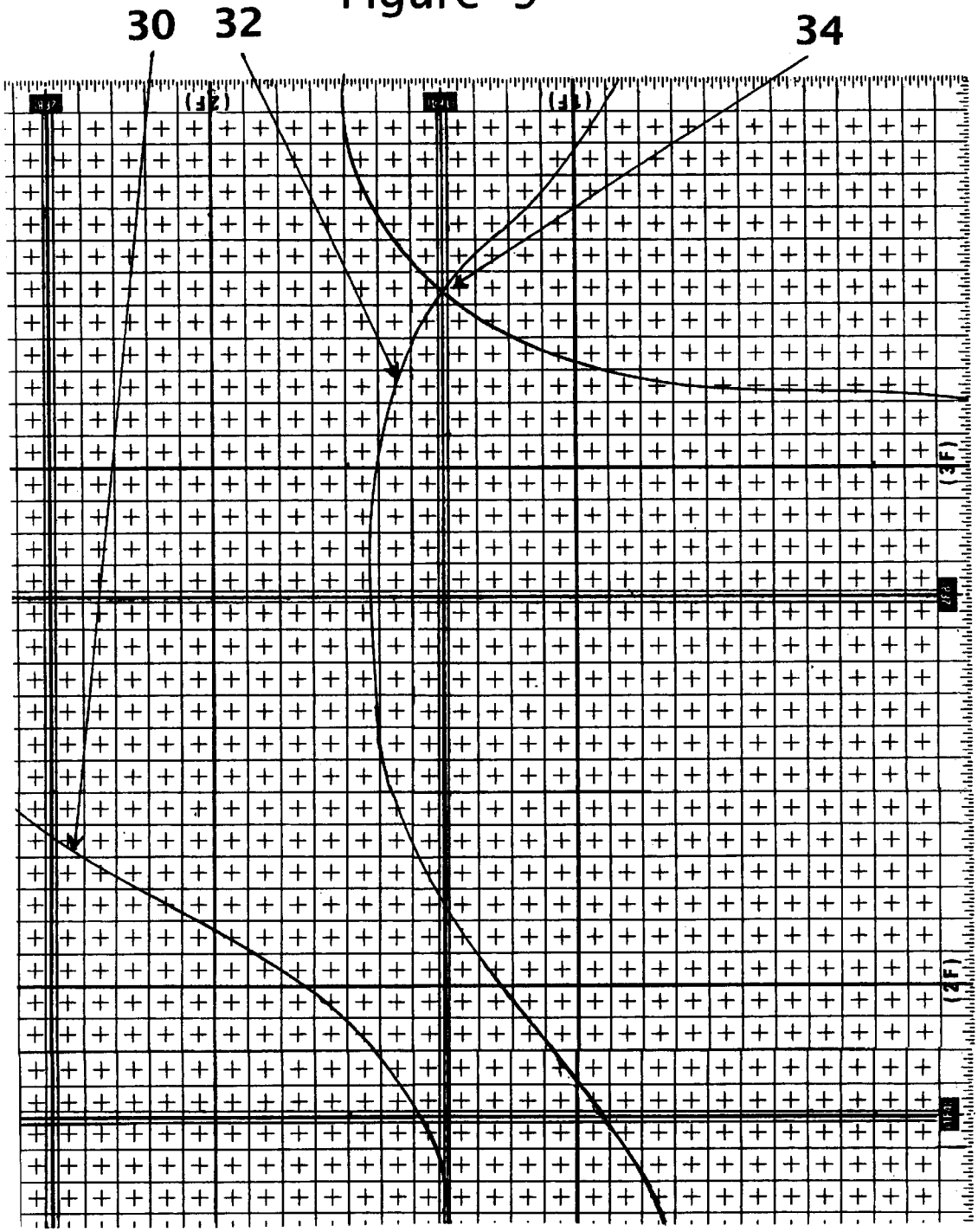
FIG. 9 is a sectional top view of a ninth preferred embodiment of the invention having special purpose curved lines positioned over unit measurement markings.

FIGS. 7–9 show three additional embodiments of gridded measurement system 2. FIG. 7 shows the present invention having nailing guides 26 positioned over unit measurement marking lines. However, the size and configuration of nailing guides 26 are not critical as long as they can be easily and rapidly identified by a user (not shown). In the preferred embodiment it is also contemplated that nailing guides 26 be marked with contrasting colors for enhanced visibility. Although in FIG. 7 nailing guides are shown positioned over intersections of unit measurement markings and positioned at the mid-point between two unit measurement markings, it is contemplated for nailing guides to be positioned anywhere on the present invention necessary to satisfy a specialized construction purpose.

FIG. 8 shows the present invention having a product specification marking 28 thereon. In the preferred embodiment of the present invention it is contemplated for product specification markings 28 to include but not limited to trademarked logos, manufacturer names, the logos of builders and developers, and the names and logos of retailers and distributors. In the preferred embodiment it is also contemplated for product specification markings 28 to be marked upon gridded measurement system 2 in contrasting colors for enhanced visibility, and also to be placed upon gridded measurement system 2 in such a way as to not totally obscure the unit measurement markings beneath them. The placement and size of product specification markings 28 are not critical as long as the unit measurement markings of gridded measurement system 2 are not obscured or rendered slow to use. FIG. 9 shows gridded measurement system 2 having short curved lines 30, extended curved lines 32, and curved line intersections 34 positioned thereon to meet special purpose construction needs such as, but not limited to, those of the marine industry. In the preferred embodiment it is contemplated for short curved lines 30, extended curved lines 32, and curved line intersections 34 to be marked with contrasting colors for enhanced visibility. The number and positioning of short curved lines 30, extended curved lines 32, and curved line intersections 34 used is not critical.

As one can see from the above descriptions of the nine embodiments, many more combinations of protractor markings 16; inverted numerals 18; reversed and inverted centrally positioned one-fourth inch markings 6, one-eighth inch markings 20, one-half inch markings 8, and one inch markings 10; reversed and inverted perimeter horizontal and vertical measurement markings which include one-fourth inch markings 6, one-eighth inch markings 20, one-half inch markings 8, and one inch markings 10; number blocks 22, informational markings 24, nailing guides 26, product specification markings 28, short curved lines 30, extended curved lines 32, and curved line intersections 34 are within the scope of the present invention. For example, inverted numerals 16 could be combined with both protractor markings 16 and reversed and inverted centrally positioned one-fourth inch markings 6, one-eighth inch markings 20, one-half inch markings 8, and one inch markings 10 to form a tenth embodiment of gridded measurement system 2. Similarly, number blocks 22 could be combined with protractor markings 16 to form an eleventh embodiment of gridded measurement system 2, and number blocks 22 could be combined with protractor markings 16 and centrally positioned one-fourth inch markings 6, one-eighth inch markings 20, one-half inch markings 8, and one inch markings 10 to form a twelfth embodiment thereof. Further, product specification markings 28 in the form of a company logo could be added to nailing guides 26 and any other of the above-mentioned features of other embodiments to create a distinct and different embodiment. Thus, the present invention should be determined by the content of the claims and not limited only to the examples given.

Through the use of the present invention alone, a person needing to cut a piece of construction material having improved gridded measurement system 2 imprinted thereon can make precise angled cuts, precise straight cuts, or combinations of straight and angled cuts in construction materials with greater speed and accuracy than is possible with prior art means of measuring construction materials for cutting. The addition of nailing guides 26 to the present invention would allow pieces of construction material to also be more rapidly secured into place. With the present invention remnant pieces of construction materials (not shown) can be instantly assessed for size and straight edges. Also, once in place, construction material having gridded measurement system 2 imprinted thereon can be used as a handy on-site measurement reference for a variety of subsequent measuring and placement needs. Dual use of horizontal and vertical unit measurement markings in different measuring systems is also contemplated on the same sheet of construction material, such as the use of one inch markings 10 in combination with metric system markings. One measuring system could be displayed on one side of the sheet while the second system imprinted for display on the opposite side of the sheet, or the markings from the different measuring systems could be displayed adjacent to one another on the same side of the sheet. Use of dual markings from more than one measurement system would permit the present invention to be rapidly used on a wider variety of job sites.

What is claimed is:

1. An improved added measurement system for use on at least one surface of a substantially rectangular piece of construction material so as to provide a visually precise means for fast and accurate cutting and installing of construction materials whereby use thereof will reduce construction costs by minimizing the amount of labor required to measure construction materials, secure said construction materials in place, as well as minimize material waste due to inaccurate cutting of the piece of construction material, said improved gridded measurement system comprising a plurality of visually precise horizontal unit measurement markings and a plurality of visually precise perimeter vertical unit measurement markings, a plurality of successively higher visually precise numbers associated with said horizontal unit measurements markings and said vertical unit measurements markings, a plurality of visually precise grid markings substantially filling the central portion of the construction material, said system also comprising marking means for visually precise marking of said unit measurement markings, said grid markings, and said successively higher numbers onto the construction material surface, said system further comprising two each of said horizontal unit measurement markings and said vertical unit measurement markings being positioned around the perimeter of the piece of construction material and the remainder of said horizontal unit measurement markings and said vertical unit measurement markings being positioned uniformly throughout the central portion of the piece of construction material to form non-perimeter horizontal and vertical unit measurement markings, wherein the improvements comprise a plurality of visually precise inverted numerals, each of said inverted numerals being identical to one of said numerals and placed in a position close thereto and each of said grid markings also having a spaced apart horizontal distance from the next adjacent one of said grid markings which is identical to the dimension of said horizontal unit measurement markings and a spaced apart vertical distance from the next adjacent one of said grid markings which is identical to the dimension of said vertical unit measurement markings.

2. The system of claim 1 further comprising a plurality of additional horizontal and vertical unit measurement markings each having a plurality of successively higher numbers associated therewith, each of said additional horizontal measurement markings positioned adjacent to one of said horizontal unit measurement markings in an inverted position thereto, and each of said additional vertical measurement markings positioned adjacent to one of said vertical unit measurement markings in an inverted position thereto.

3. The system of claim 1 further comprising a plurality of additional horizontal and vertical unit measurement markings each having a plurality of successively higher numbers associated therewith, each of said additional horizontal measurement markings positioned adjacent to one of said horizontal unit measurement markings in a position where said successively higher numbers of each of said additional horizontal measurement markings are in reverse order relative to said successively higher numbers of the one of said horizontal unit measurement markings positioned adjacent thereto, and each of said additional vertical measurement markings positioned adjacent to one of said vertical unit measurement markings in a position where said successively higher numbers of each of said additional vertical measurement markings are in reverse order relative to said successively higher numbers of the one of said vertical unit measurement markings positioned adjacent thereto.

4. The system of claim 2 wherein said successively higher numbers of each of said additional horizontal measurement markings are in reverse order relative to said successively higher numbers of the one of said horizontal unit measurement markings positioned adjacent thereto, and wherein said successively higher numbers of each of said additional vertical measurement markings are in reverse order relative to said successively higher numbers of the one of said vertical unit measurement markings positioned adjacent thereto.

5. The system of claim 1 wherein said visually precise horizontal and vertical unit measurement markings are dimensioned for application to pieces of construction material selected from a group consisting of sheets having all combinations of length and width dimensions ranging between approximately one foot and thirty-six feet and a thickness dimension ranging between a minimum of approximately one-eighth of an inch and a maximum of approximately four inches.

6. The system of claim 5 further configured for application to pieces of construction material selected from a group consisting of engineered wood products including oriented strand board (OSB); fiber cement products; combination products comprising both fiber cement and wood fiber; cementatious products; products comprising radiant barriers; tongue-and-groove panel products; panel products with one or more ship-lap type edges on one side; panel products with one or more ship-lap type edges on both sides; panel products with paint grade type faces; panel products with decorative paintable faces consisting of grooved patterns; and panel products with decorative paintable faces consisting of various wood grain textures including T-111.

7. The system of claim 1 wherein said unit measurement markings comprise visually precise one inch markings.

8. The system of claim 1 further comprising a plurality of visually precise fractional measurement markings positioned on the construction material surface between said perimeter horizontal unit measurement markings and also between said perimeter vertical unit measurement markings.

9. The system of claim 8 wherein said visually precise fractional measurement markings are laser cut with flexigraphic plates and are accurate to at least approximately one-one-thousandth of an inch.

10. The system of claim 1 further comprising a plurality of highlighted markings positioned in both horizontal and vertical directions on top of the ones of said unit measurement markings which are commonly used in construction so that said highlighted markings may be quickly referenced by a user.

11. The system of claim 10 wherein said highlighted markings are selected from a group consisting of color enhanced markings, multiple color markings, fluorescent markings, multiple lines, dotted lines, lines comprising a plurality of identical figures uniformly spaced apart from one another, lines comprising a plurality of non-identical figures uniformly spaced apart from one another, and dashed lines having a plurality of segments identical in length and positioned at equally spaced apart distances from one another.

12. The system of claim 7 further comprising a plurality of highlighted markings positioned in both horizontal and vertical directions on top of every one of said one inch markings which is a multiple of twelve for quick reference by a user and wherein said highlighted markings are selected from a group consisting of color enhanced markings, multiple color markings, fluorescent markings, multiple lines, dotted lines, lines comprising a plurality of identical figures uniformly spaced apart from one another, lines comprising a plurality of non-identical figures uniformly spaced apart from one another, and dashed lines having a plurality of segments identical in length and positioned at equally spaced apart distances from one another.

13. The system of claim 12 wherein said improvement further comprises a plurality of visually precise protractor markings each centered over an intersection of two of said highlighted markings which is a multiple of twelve.

14. The system of claim 13 further comprising a plurality of additional highlighted markings positioned in both horizontal and vertical directions on top of every one of said one inch markings which is a multiple of sixteen for quick reference by a user and wherein said additional highlighted markings are selected from a group consisting of color enhanced markings, multiple color markings, fluorescent markings, multiple lines, dotted lines, lines comprising a plurality of identical figures uniformly spaced apart from one another, lines comprising a plurality of non-identical figures uniformly spaced apart from one another, and dashed lines having a plurality of segments identical in length and positioned at equally spaced apart distances from one another.

15. The system of claim 1 wherein said unit measurement markings comprise visually precise metric system markings.

16. The system of claim 1 wherein said unit measurement markings comprise visually precise markings from a plurality of measurement systems.

17. The system of claim 16 wherein said unit measurement markings on one side of the piece of construction material comprise visually precise markings from a plurality of measurement systems.

18. The system of claim 1 wherein said marking means is selected from a group consisting of screen printing equipment, laser printing equipment, flexographic gravure printing equipment, and pad printing equipment.

19. The system of claim 1 wherein said improvement further comprises a plurality of number blocks, each of said number blocks comprising at least four numerals associated therewith, each of said numerals having a top with said tops positioned to be adjacent to one another, each of said number blocks being positioned at an intersection of one of said non-perimeter horizontal unit measurement markings and one of said non-perimeter vertical unit measurement markings.

20. The system of claim 1 further comprising a plurality of visually precise inter-grid markings consisting of fractional measurement markings positioned in both horizontal and vertical directions the construction material surface between said grid markings to provide a grid-within-a-grid configuration for enhanced cutting accuracy.

21. The system of claim 1 further comprising a plurality of visually precise informational markings positioned within the central portion of the piece of construction material.

22. The system of claim 1 wherein said unit measurement markings are widened to provide a thin strip within which additional unit measurement information can be placed.

23. The system of claim 1 further comprising a plurality of nailing guides being positioned within the central portion of the piece of construction material.

24. The system of claim 1 further comprising a plurality of product specification markings being positioned within the central portion of the piece of construction material.

25. The system of claim 1 further comprising a plurality of curved lines being positioned within the central portion of the piece of construction material.

26. An improved gridded measurement system for use on at least one surface of a substantially rectangular piece of construction material so as to provide a visually precise means for fast and accurate cutting and installing of construction materials whereby use thereof will reduce construction costs by minimizing the amount of labor required to measure construction materials, secure said construction materials in place, as well as minimize material waste due to inaccurate cutting of the piece of construction material, said improved gridded measurement system comprising a plurality of visually precise horizontal unit measurement markings and a plurality of visually precise perimeter vertical unit measurement markings, a plurality of visually precise fractional measurement markings positioned in both horizontal and vertical directions on said construction material surface between said unit measurement markings, a plurality of highlighted markings positioned in both horizontal and vertical directions on top of the ones of said unit measurement markings which are commonly used in construction so that said highlighted markings may be quickly referenced by a user, a plurality of successively higher numbers associated with said horizontal unit measurements markings and said vertical unit measurements markings, a plurality of grid markings positioned within the central portion of the piece of construction material, said grid markings substantially filling the central portion, each of said grid markings also having a spaced apart horizontal distance from the next adjacent one of said grid markings which is identical to the dimension of said horizontal unit measurement markings and a spaced apart vertical distance from the next adjacent one of said grid markings which is identical to the dimension of said vertical unit measurement markings, said system also comprising marking means for visually precise marking of said unit measurement markings, said grid markings, and said successively higher numbers onto said construction material surface, wherein the improvement comprises two of said horizontal unit measurement markings being positioned around the perimeter of the piece of construction material and the remainder of said horizontal unit measurement markings being uniformly positioned throughout the central portion of the piece of construction material to form non-perimeter horizontal unit measurement markings, and two of said vertical unit measurement markings being positioned around the perimeter of the piece of construction material and the remainder of said vertical unit measurement markings being uniformly positioned throughout the central portion of the piece of construction material to form non-perimeter vertical unit measurement markings.

27. The system of claim 26 further comprising a plurality of additional horizontal and vertical unit measurement markings each having a plurality of successively higher numbers associated therewith, each of said additional horizontal measurement markings being selected from the group consisting of additional horizontal measurement markings positioned adjacent to one of said horizontal unit measurement markings in an inverted position thereto, positioned adjacent to one of said horizontal unit measurement markings in a position where said successively higher numbers of said additional horizontal measurement markings are in reverse order relative to said successively higher numbers of the one of said horizontal unit measurement markings positioned adjacent thereto, and positioned where said successively higher numbers of said additional horizontal measurement markings are both inverted and in reverse order relative to said successively higher numbers of the one of said horizontal unit measurement markings positioned adjacent thereto, and each of said additional vertical measurement markings being selected from the group consisting of additional vertical measurement markings positioned adjacent to one of said vertical unit measurement markings in an inverted position thereto, positioned adjacent to one of said vertical unit measurement markings in a position where said successively higher numbers of said additional vertical measurement markings are in reverse order relative to said successively higher numbers of the one of said vertical unit measurement markings positioned adjacent thereto, and positioned where said successively higher numbers of said additional vertical measurement markings are both inverted and in reverse order relative to said successively higher numbers of the one of said vertical unit measurement markings positioned adjacent thereto.

28. The system of claim 26 wherein said unit measurement markings comprise visually precise one inch markings.

29. The system of claim 26 wherein said visually precise fractional measurement markings are laser cut with flexigraphic plates and are accurate to at least approximately one-one-thousandth of an inch.

30. The system of claim 26 wherein said highlighted markings are selected from a group consisting of color enhanced markings, multiple color markings, fluorescent markings, multiple lines, dotted lines, lines comprising a plurality of identical figures uniformly spaced apart from one another, lines comprising a plurality of non-identical figures uniformly spaced apart from one another, and dashed lines having a plurality of segments identical in length and positioned at equally spaced apart distances from one another.

31. The system of claim 26 wherein for quick reference by a user said highlighted markings are selected from a group consisting of highlighted markings positioned in both horizontal and vertical directions on top of every one of said one inch markings which is a multiple of twelve and highlighted markings positioned in both horizontal and vertical directions on top of every one of said one inch markings which is a multiple of sixteen.

32. The system of claim 26 wherein said improvement further comprises a plurality of visually precise protractor markings each centered over an intersection of two of said highlighted markings which is a multiple of twelve.

33. The system of claim 26 wherein said unit measurement markings comprise a plurality of visually precise markings selected from the group consisting of visually precise markings from a plurality of measurement systems positioned on a first side of the piece of construction material, visually precise markings from different measurement systems positioned on opposite sides of the piece of construction material, and visually precise markings from a plurality of measurement systems positioned on said first side of the piece of construction material with visually precise markings from a different measurement system positioned the side opposed to the first side.

34. The system of claim 26 wherein said marking means is selected from a group consisting of screen printing equipment, laser printing equipment, flexographic gravure printing equipment, and pad printing equipment.

35. The system of claim 26 wherein said improvement further comprises improvements selected from the group consisting of a plurality of number blocks, each of said number blocks comprising at least four numerals associated therewith, each of said numerals having a top with said tops positioned to be adjacent to one another, each of said number blocks being positioned at an intersection of one of said non-perimeter horizontal unit measurement markings and one of said non-perimeter vertical unit measurement markings; a plurality of visually precise inter-grid markings consisting of fractional measurement markings positioned in both horizontal and vertical directions on said construction material surface between said grid markings to provide a grid-within-a-grid configuration for enhanced cutting accuracy; a plurality of inverted numerals, each of said inverted numerals being identical to one of said numerals and placed in a position close thereto; a plurality of visually precise informational markings positioned within the central portion of the piece of construction material; said unit measurement markings being widened to provide a thin strip within which additional unit measurement information can be placed; a plurality of nailing guides being positioned within the central portion; a plurality of product specification markings being positioned within the central portion; and a plurality of curved lines also being positioned within central portion.

36. An improved method for faster and more accurate cutting of construction materials on a job site whereby use thereof will reduce construction costs by minimizing the amount of labor required to measure construction materials as well as minimizing material waste due to inaccurate cutting of construction materials, said method comprising the steps of providing a plurality of rectangular pieces of construction material and at least one cutting tool, wherein said providing of said pieces of construction material comprises the providing of pieces which have been marked with visually precise horizontal unit measurement markings and visually precise vertical unit measurement markings around the complete perimeter of at least one surface of each of said pieces of construction material, a plurality of visually precise successively higher numbers onto each of said pieces of construction material so that each of said numbers becomes associated with one of said unit measurements markings, a plurality of visually precise fractional markings onto each of said pieces of construction material between each of said horizontal unit measurement markings and vertical unit measurement markings, a plurality of visually precise grid markings centrally upon each of said construction material surfaces so that said grid markings substantially fill each construction material surface between said perimeter horizontal unit measurement markings and said perimeter vertical unit measurement markings, said grid markings each being marked so that it has a spaced apart horizontal distance from the next adjacent one of said grid markings which is identical to the dimension of each of said perimeter horizontal unit measurement markings and a spaced apart vertical distance from the next adjacent one of said grid markings which is identical to the dimension of each of said perimeter vertical unit measurement markings; determining the horizontal and vertical dimensions of the required cut in each piece of construction material provided; instantaneously identifying said horizontal dimension visually along one of said horizontal unit measurement markings on said construction material surface; instantaneously also identifying said vertical dimension visually along one of said vertical unit measurement markings on said construction material surface; and using said cutting tool to make said required cut between said identified perimeter horizontal unit measurement marking and said identified perimeter vertical unit measurement marking while concurrently using said grid markings to guide said cutting tool in a straight line path between each of said identified perimeter horizontal unit measurement markings and the corresponding ones of said identified perimeter vertical unit measurement markings, wherein the improvement comprises the additional steps of providing pieces of said construction materials which have also been marked with a plurality of precise non-perimeter horizontal unit measurement markings and a plurality of precise non-perimeter vertical unit measurement markings uniformly throughout the central portion of said construction material surface and visually using said non-perimeter horizontal unit measurement markings and said non-perimeter vertical unit measurement markings to also guide said cutting tool for improved speed and accuracy of making said required cut.

37. The method of claim 36 further comprising the step of providing said pieces of construction material also having additional features selected from the group consisting of a plurality of highlighted markings in both horizontal and vertical directions onto said construction material surface in association with those of said unit measurement markings which are commonly used in construction, a plurality of inverted numerals on said construction material surface which are identical to the numeral positioned adjacent thereto, a plurality of number blocks on said construction material surface, a plurality of inverted and reversed unit measurement markings and a plurality of inverted and reversed fractional measurement markings onto said construction material surface, a plurality of informational markings on said construction material surface, a plurality of nailing guides, a plurality of product specification markings, and a plurality of curved lines, and said method also further comprising the step of visually using said additional features for more accurately and rapidly identifying needed unit measurement markings to further guide said cutting tool for improved speed and accuracy of making said required cut.

38. The method of claim 36 wherein said step of providing said pieces of construction materials comprises the step of providing pieces of construction materials which have been marked with equipment selected from a group consisting of screen printing equipment, laser printing equipment, flexographic gravure printing equipment, and pad printing equipment.

39. The method of claim 36 further comprising the step of using opposite corners of a plurality of said grid markings to make angled cuts.

40. The method of claim 36 further comprising the steps of providing said pieces of construction material having a plurality of visually precise protractor markings on said construction material surface, and using said protractor markings in combination with said opposite corners of said grid markings to make angled cuts through said construction material surface.

* * * * *